US012398547B2

(12) United States Patent
Loeck et al.

(10) Patent No.: US 12,398,547 B2
(45) **Date of Patent: *Aug. 26, 2025**

(54) TOUCHLESS FAUCET ASSEMBLY AND METHOD OF OPERATION

(71) Applicant: Kohler Co., Kohler, WI (US)

(72) Inventors: Jonathan P. Loeck, Sherwood, WI (US); Ramesh Annapindi, San Francisco, CA (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/518,826

(22) Filed: Nov. 24, 2023

(65) Prior Publication Data

US 2024/0159033 A1 May 16, 2024

Related U.S. Application Data

(63) Continuation of application No. 17/072,213, filed on Oct. 16, 2020, now Pat. No. 11,859,375, which is a continuation of application No. 16/126,904, filed on Sep. 10, 2018, now Pat. No. 10,837,161, which is a continuation of application No. 14/703,338, filed on May 4, 2015, now Pat. No. 10,125,478, which is a continuation of application No. 12/639,112, filed on Dec. 16, 2009, now Pat. No. 9,032,565.

(51) Int. Cl.
*E03C 1/05* (2006.01)

(52) U.S. Cl.
CPC ..... *E03C 1/057* (2013.01); *E03C 1/05* (2013.01); *Y10T 137/9464* (2015.04)

(58) Field of Classification Search
CPC ..... F16K 31/05; F16K 31/02; E03C 1/055; E03C 1/057
USPC ..... 4/679, 682
See application file for complete search history.

(56) References Cited

U.S. PATENT DOCUMENTS

RE37,888 E * 10/2002 Cretu-Petra ..... E03C 1/057 236/12.12

* cited by examiner

*Primary Examiner* — Lauren A Crane
(74) *Attorney, Agent, or Firm* — Husch Blackwell LLP

(57) ABSTRACT

A faucet assembly includes a base for mounting adjacent a basin of a sink and a spout projecting upward and outward away from the base and terminating at a water outlet. A light emitter is mounted to one section of the spout and emits a beam of light directed toward another section of the spout, wherein the beam of light does not intersect a region beneath the outlet. A light sensor, mounted to the spout, produces a signal indicating whether the beam of light is striking the light sensor. A control circuit responds to the signal by opening a valve that thereby conveys water to the spout.

20 Claims, 3 Drawing Sheets

TOUCHLESS FAUCET ASSEMBLY AND METHOD OF OPERATION

CROSS-REFERENCE TO RELATED PATENT APPLICATIONS

This application is a continuation of U.S. patent application Ser. No. 17/072,213, filed Oct. 16, 2020, which is a continuation of U.S. patent application Ser. No. 16/126,904, filed Sep. 10, 2018 (now U.S. Pat. No. 10,837,161) which is a continuation of U.S. patent application Ser. No. 14/703,338, filed May 4, 2015 (now U.S. Pat. No. 10,125,478), which is a continuation of U.S. patent application Ser. No. 12/639,112, filed Dec. 16, 2009 (now U.S. Pat. No. 9,032,565), and such applications are incorporated by reference herein in their entireties.

BACKGROUND

The present application relates to touchless faucets, and more particularly to such faucets that employ a light beam to sense presence of a person and activate the faucet in response to that sensing.

In hospitals, public rest rooms, and other facilities, it is commonplace to provide a faucet which is turned on and off without requiring the user to touch the faucet. The prior art is replete with devices for sensing the presence of a user and, in response thereto, activating a solenoid valve assembly that controls the flow of water to a faucet. A common sensing technique, as described in U.S. Pat. No. 4,915,347, involves transmitting an infrared light beam into a flow region underneath the outlet of the faucet spout, where a user's hands or other objects are placed for washing. A hand or object so placed reflects some of the infrared light beam back toward the faucet, where that reflected light is detected by a sensor mounted either on or adjacent the faucet. Detection of reflected light at the sensor indicates the presence of a user in front of the faucet. In response to receiving the reflected light, the sensor emits an electrical signal that causes the solenoid valve to open, sending water from the faucet. When the detection of reflected light ceases, the solenoid valve is de-energized, terminating the flow of water.

A problem with such proximity activated faucets is that room elements near the faucet, such as a mirror or shiny sink surfaces, can reflect light back to the sensor, thereby falsely triggering the flow of water. Inanimate objects, such as handbags, placed on the front edge of the sink also can falsely cause faucet operation. The false activation of the faucet not only wastes water, but may result in water overflowing the sink, if an unattended object also is blocking the drain opening.

Prior touchless faucets were not practical for kitchen sinks which are used for operations, such as draining water from a cooking pot or cutting vegetables, during which water from the faucet is not desired. Thus during such activities, the presence of a hand or other object beneath the faucet outlet should not activate the flow of water.

SUMMARY

A faucet assembly includes spout having a base for mounting adjacent a basin of a sink. The basin is the recessed portion of the sink that is designed to receive and retain water. The spout projects upward and away from the base over the basin and terminates at an outlet from which a stream of water is to be produced in a flow region beneath the outlet. A light emitter and a light sensor are mounted to the spout. The light emitter projects a beam of light toward the spout base without the beam of light intersecting the flow region beneath the spout where the water sprays from the outlet. The light sensor produces a signal indicating whether the beam of light is striking the light sensor. In response to the signal, a control circuit opens a valve, thereby conveying water through the spout.

In one embodiment of this faucet assembly, the light sensor is mounted to the spout base and the light emitter is mounted proximate to the spout outlet with the light beam directed at the light sensor. Here, a person interrupts the light beam, with his or her hands for example, which interruption is indicated by the signal from the light sensor. The control circuit responds to that signal by opening a valve which supplies water to the faucet spout. The light may be in the visible spectrum to provide an indication to the person when the hands have interrupted the light beam. The water valve may remain open until either a predefined time interval elapses or the light beam is interrupted again, which ever occurs first.

In another faucet assembly embodiment, the light emitter and light sensor are proximate to each other on the spout and the light sensor responds to the reflection of the light beam by an object, such as a person's hands. In this case, the control circuit opens the valve in response to the signal indicating receipt of the light beam by the light sensor. Here too, the water valve may remain open until either a predefined time interval elapses or the light beam is interrupted again, whichever occurs first.

Because the light beam does not intersect the flow region beneath the spout where the water sprays from the outlet, a person can use the sink without triggering the flow of water. For example, the person may wash dishes in water retained in the sink or empty a pot of water without impinging the light beam and activating the faucet. Thus the faucet assembly is particularly adapted for use at sinks where activities other than washing hands occur.

DETAILED DESCRIPTION

Figure 1:
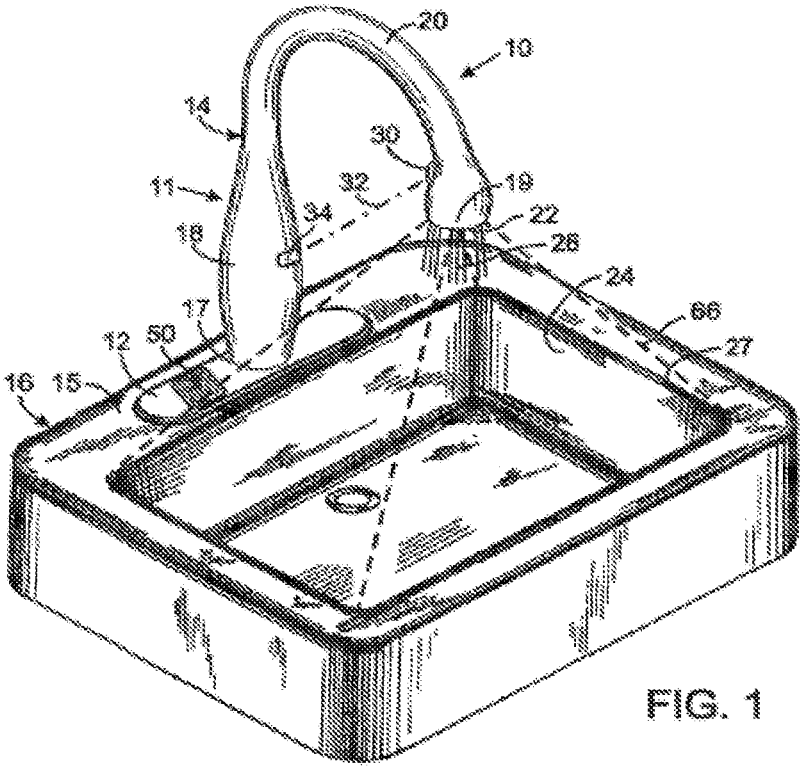
FIG. 1 is a prospective view of a sink on which a faucet assembly, according to an exemplary embodiment, is mounted.

With initial reference to FIG. 1, a faucet assembly 10 includes a faucet 11 that has a mounting plate 12 and a spout 14. The mounting plate 12 is adapted to stand on the rim 15 of a sink 16 or on a counter surrounding an under-the-counter mounted sink. Some stylized faucets do not have a mounting plate 12 and the bottom of the spout 14 is mounted directly to the surface adjacent the basin 24 of the sink 16. The spout 14 extends upward from the mounting plate 12 in an inverted J-shaped manner. Specifically, the spout 14 has a first end 17 with a generally vertical, tubular base 18 projecting upward from the mounting plate 12 and connecting into a tubular, arched portion 20 that curves upward and outward over the sink basin 24 and then continues curving downward terminating at a second end 19 that has a water outlet 22. The water outlet 22 has a nozzle from which a stream 26 of water flows when the faucet assembly 10 is activated. Although the present embodiment is being described in the context of a high arching type spout, the faucet 11 may have other types of spouts which project upward and forwardly outward from a base section to a water outlet. The faucet 11 may have a pull-out style spray head in which the water outlet is attached to a hose that extends through the spout.

A light emitter 30, such as a semiconductor laser, light emitting diode (LED) or other device that emits a beam 32 of light, is mounted on the spout 14 adjacent the water outlet 22 and facing the base 18. The light emitter 30 is oriented to direct the light beam 32 in a downward angle toward the base. A light sensor 34 is located on the base 18 at a position to receive the beam 32 of light. For this embodiment, a semiconductor laser has the advantage of producing a highly collimated, narrow light beam 32 whereby most, if not all, of the light impinges the sensor 34. Nevertheless light from another type of emitter that is focused into a narrow beam also may be used. Such as narrow light beams provides a relatively small object detection zone along the path of that beam. Preferably, the light is visible to the human eye, so that when a hand of a user or other item blocks the light beam 32, a visible spot of light appears on that object to indicate that the beam has been interrupted. Nonetheless, a beam of invisible light, such as in the infrared spectrum, can be utilized. Alternatively, the locations of the light emitter 30 and the sensor 34 can be reversed, wherein the light emitter is mounted on or proximate the base 18 and the sensor is on or proximate the spout, however with this variation a spot of light on the hands may not be visible to the user. This alternative also may allow some of the emitted light to travel visibly across the room in which the sink 16 is located.

Figure 2:
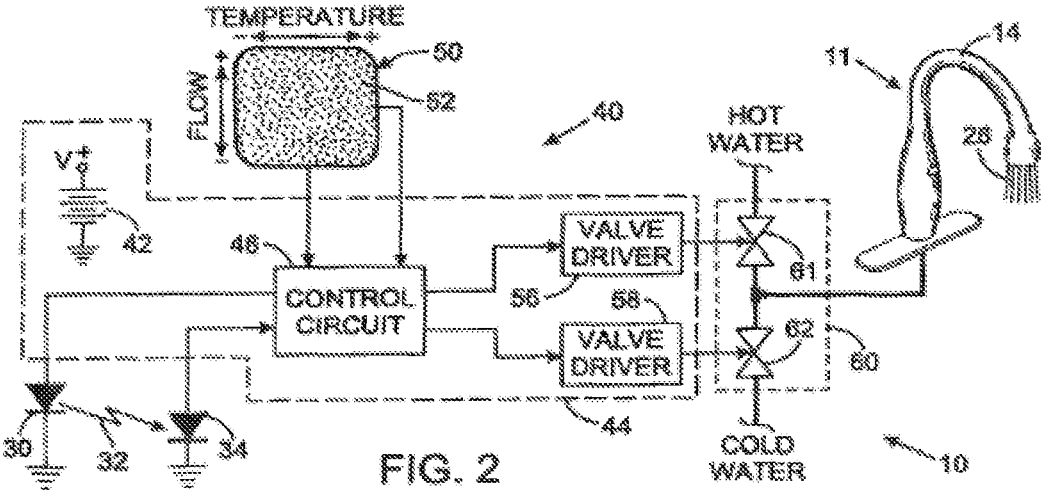
FIG. 2 is a block diagram of an electrical circuit for controlling the flow of water from the faucet assembly.

Operation of the faucet assembly 10 is controlled by an electrical circuit 40 shown in FIG. 2 in which the light emitter 30 and the sensor 34 are connected to a controller 44. The controller 44 is powered by a battery 42 or a low voltage DC power supply connected to a 110 or 220 volt AC electrical system in a building. The light emitter 30 is activated periodically by an output signal from a control circuit 46 and when activated, produces a beam 32 of light. Upon being impinged by the light beam 32, the sensor 34 produces an electrical signal that is applied to an input of the control circuit 46. Any of several well-known signal processing techniques or filters can be employed to prevent light in the room from activating the faucet assembly 110.

The control circuit 46 preferably is microcomputer based and has a memory that stores a control program which governs operation of the faucet assembly 10 and stores data used by that control program. Inputs of the control circuit 46 are connected to a user input device 50 that in the illustrated embodiment is a touchpad, such as commonly found on laptop computers for the user to move a cursor on the display screen. The touch pad produces output signals indicating a two dimensional location on the surface of the touch pad that is touched by the user. The X signal for one orthogonal axis of touch pad indicates the desired temperature of the water discharged from the faucet 11, while the Y signal for the other orthogonal axis indicates a desired flow rate of that water. By touching different locations on the touchpad the user is able to change the temperature and flow rate. Alternatively conventional pushbutton switches can be employed as the user input device 50 by which the user increases and decreases the water temperature and flow rate. Pushbutton switches also may be provided for selecting preset water temperatures or flow rates that have been programmed into the control circuit 46.

When the faucet 11 is not being used, the light beam 32 travels from the emitter 30 to the light sensor 34, thereby producing an electrical signal that is applied to an input of the control circuit 46. As long as the control circuit 46 receives that electrical signal, a determination is made that a user is not present at the faucet 11 and the water is not permitted to flow to the faucet spout 14.

Referring again to FIG. 1, note that the light beam 32 does not intersect a "flow region" beneath the outlet 22 through which the outlet water stream 26 flows, nor does it intersect any region beneath the water outlet 22 in which the user typically places hands or other objects for washing or other sink use. In one embodiment, the light beam 32 does not intersect a larger "work region" 66 which extends downward from the second end 19 of the spout to the edge of the upper opening 27 of the basin 24. For the exemplary rectangular basin 24, the work region 66 has the form of a rectangular pyramid, edges of each side being indicated by dashed lines in FIG. 1, however for an circular or oval basin, the work region is conical. In other words, the work region 66 has a lower boundary defined by the upper opening 27 of the basin 24 and tapers upward to the second end 19 of the spout at which the water outlet 22 is located. The work region 66 may in addition include the interior of the basin 24, thus being bounded further by the side walls and bottom of the basin.

The path of the light beam 32, by avoiding the flow region and work region, allows a person to use the sink without activating the water flow. For example, a large pot of water may be emptied into the sink or dishes can be washed in water retained in the basin without that activity interrupting the light beam 132 and thereby triggering the water flow. As used herein the "flow region beneath the outlet" refers to the space under the faucet spout where an object is placed so that water from the outlet will impinge upon the object and excludes other spaces below the vertical location of the outlet where water from the outlet will not strike an object placed there. Although in first faucet assembly 10, the light sensor 34 is lower than the water outlet 22, the sensor is set back toward the rear of the sink, so that the light beam 32 that is aimed at the sensor does not intersect the flow region beneath the outlet 22 that is defined by the outlet water stream 26.

When a user approaches the sink 16 and desires to activate the faucet 11, his or her hand or another object is placed between the light emitter 30 and sensor 34, thereby interrupting the light beam 32. The path of the narrow light beam 132 defines a detection zone. As noted previously, it is preferred that the light is in the visible spectrum so as to produce a perceptible spot of light on the object to indicate to the user that the light beam is blocked. Furthermore, this spot is visible to the user because the light travels from adjacent the water outlet 22 of the faucet downward toward the back of the sink basin 24 and near the tubular base 18 of the faucet spout. This path illuminates a portion of the hand or the other object that is visible to the user.

Referring again to FIG. 2, interrupting the light beam 32 in this manner terminates the previously occurring electrical signal produced by the light sensor 34 and applied to the input of the control circuit 46. When the control circuit 46 recognizes that it is not receiving an input signal in response to activating the light emitter 30, a determination is made that a person is present and desires to use the sink 16. In response to that determination, the control circuit 46 sends output signals which cause a pair of valve drivers 56 and 58 to open a valve assembly 60 that comprises two proportional solenoid valves 61 and 62. The two solenoid valves 61 and 62 respectively control the flow of hot and cold water to the spout 14. Specifically, the outlets of the two solenoid valves 61 and 62 are connected together to produce a mixture of the hot and cold water that is fed through the spout 14 to produce the outlet water stream 26. The valve assembly 60 may employ other electrically operated valve arrangements to produce a mixture of hot and cold water. The valve assembly 60, along with the controller 44, usually are located beneath the sink 16.

The amounts to which the hot and cold solenoid valves 61 and 62 are opened are specified independently by respective first and second values stored within the memory of the control circuit 46. Those values are set by the signals from the user input device 50 and are used by the control circuit to determine the magnitude of the control signals sent to the valve drivers 56 and 58 and thus the level of electric current applied to each proportional solenoid valve 61 and 62. With reference to the orientation of the touch pad 52 in FIG. 2, touching a finger to different locations along the horizontal axis of the touch pad designate different desired temperatures. The resultant signal for that axis of the touch pad 52 causes the control circuit to increases or decrease the first value which designates the amount that the hot water solenoid valve 61 is to open, and changes the second value in the opposite manner to alter the amount that the cold water solenoid valve 62 is to open. For example, moving a finger to the right on the touch pad 52 designates that the water temperature should increase which results in the first value for the hot water solenoid valve 61 increasing and the second value for the cold water solenoid valve 62 decreasing. This action sends more hot water and less cold water to the spout 14.

Touching different locations along the vertical axis of the touch pad 52, oriented as in FIG. 2, alters the water flow rate by modifying both the first and second values by the same amount and to alter the changing the opening of both solenoid valves 61 and 62 equally. It should be understood that the two solenoid valves 61 and 62 may not be opened the same amounts as the water temperature setting may designate a greater amount of hot or cold water. For example, moving a finger downward on the touch pad 52 designates that the water flow rate should decrease. This movement will decrease both the first and second values by identical amounts which decreases the flow rates of the hot and cold water to the same extent while maintaining the same proportion of flow rates and thus the same temperature mixture of the water from the faucet 11.

Reference herein to directional relationships and movements, such as horizontal and vertical, up and down, or left and right, refer to a relationship and movement associated with the orientation of components as illustrated in the drawings, which may not be the orientation of those components when installed on or near a sink.

After interruption of the light beam has been indicated either by a spot of light on the user's hand or by water commencing to flow from the faucet, the hands of the user can be removed from blocking the light beam. Once activated, the faucet 11 may remain open for a fixed period of time, as determined by a software timer implemented by the microcomputer within the control circuit 46. During that time period, the control circuit continues to periodically activate the light emitter 30 and inspect the signal produced by the light sensor 34. If the user interrupts the light beam 32 again while water is flowing from the spout 14, the two solenoid valves 61 and 62 are closed immediately even though the fixed period of time has not elapsed. Alternatively, the faucet assembly 10 could be configured so that the two solenoid valves 61 and 62 remain open only while the light beam 32 continues to be interrupted.

A person may use the sink without turning on the water. The person may work underneath the spout outlet 22 and not activate the water flow because the light beam does not intersect the flow region beneath the outlet 22 or the larger work region 66. Thus the person may peel vegetables, place dishes in the sink, or empty a pan of water without water flowing from the spout. The location of the detection zone defined by the path of the light beam 32 allows such use of the sink. Anytime that water flow from the spout 14 is desired, the user simply moves a hand or other object through the detection zone defined by the light beam 32, thereby momentarily interrupting the light beam.

Figure 3:
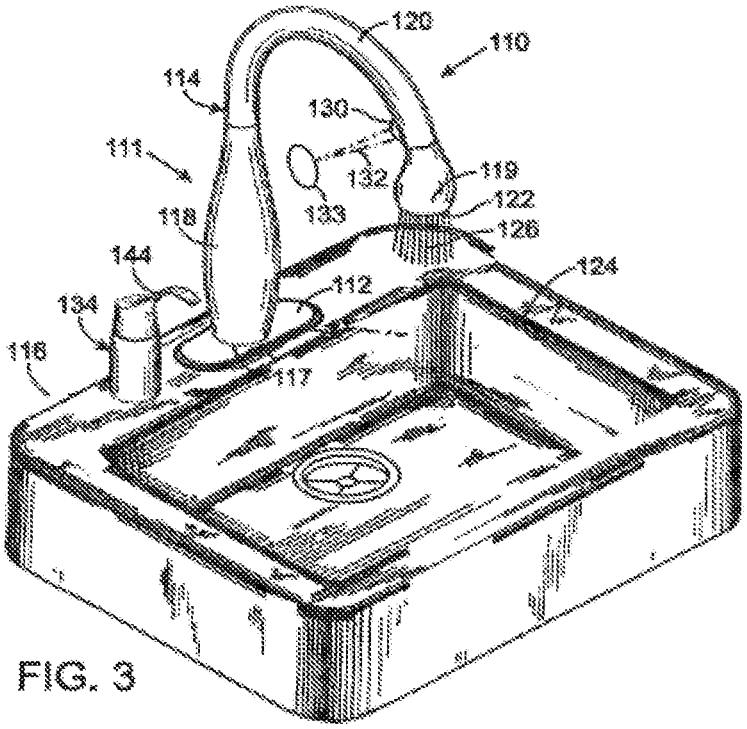
FIG. 3 is a prospective view of a sink with second faucet assembly mounted thereto.

Referring to FIG. 3, a second faucet assembly 110 includes a faucet 111 that has a mounting plate 112 affixed adjacent the basin 124 of a sink 116 and has a spout 114 projecting upward from the mounting plate inverted J-shaped manner. Specifically, the spout 114 has a generally vertical, tubular base 118 extending upward from a first end 117 abutting the mounting plate 112 and connecting into an arched portion 120 that curves upward and outward over the sink basin 124. The arched portion 120 continues curving downward to a remote second end 119 of the spout 114. The second end 119 has a water outlet 122, also referred to as a spray head, which produces a stream of water 126 when water flows through the spout.

A proximity detector 130 is mounted on the spout 114 near the second end 119 and faces the base 118. The proximity detector 130 incorporates a light emitter, such as a light emitting diode (LED), and a light sensor similar to components 30 and 34 in the first faucet assembly 10. The light emitter and light sensor are arranged near to each other so as to project a narrow beam 132 of visible light downward toward the spout base 118 and sense any light that is reflected back to the detector by an object 133, such as a user's hands, that may be placed in the light beam. The path of the light beam 132 forms a detection zone which does not intersect the flow region beneath the water outlet 122, through which the outlet water stream 26 flows, nor does the light beam intersect the work region of the sink.

Figure 4:
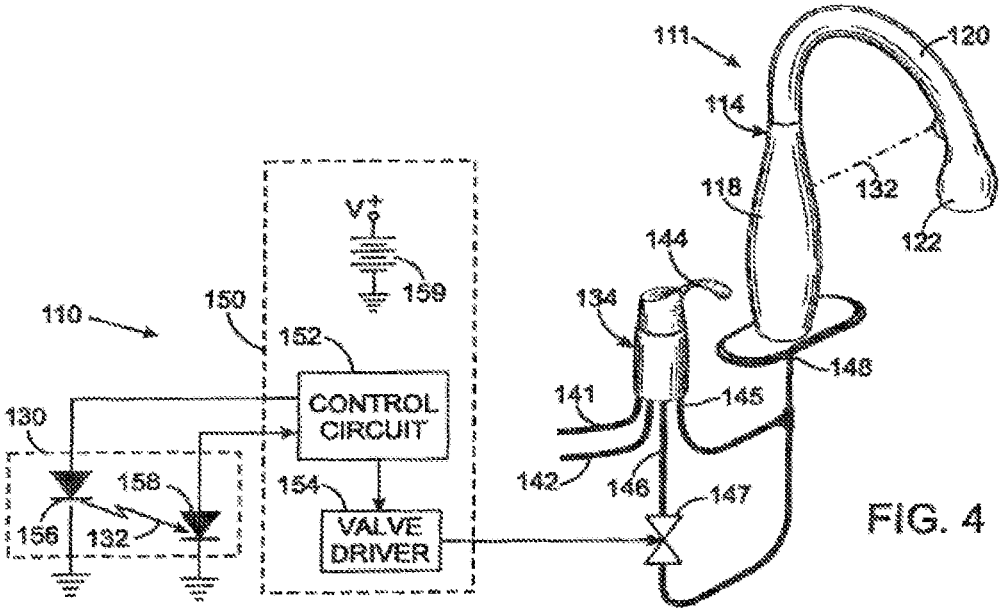
FIG. 4 is a diagram illustrating the plumbing and controller associated with the second faucet assembly.

The second faucet assembly 110 includes a manually operated mixing valve 134 that is mounted on the rim of the sink adjacent the mounting plate 112. Alternatively, the mixing valve could be incorporated into the tubular base 118 of the spout 114 as long as a separate outlet is provided for an automatic mixing valve assembly 147, as will be described. With reference to FIG. 4, this type of mixing valve 134 has a mixing stage that combines water from hot and cold water supply lines 141 and 142 into an intermediate chamber. The proportion of the hot and cold water that mixes in the intermediate chamber is varied by the rotational position of a lever 144. The mixing valve 134 has a flow shutoff valve that, when open, allows water to flow from the intermediate chamber to a first outlet 145. The flow shutoff valve is closed by tilting the lever 144 into the downward most position. Raising the lever 144 from that downward most position opens the flow shutoff valve and the amount that the lever is raised proportionally controls the rate of water flow to the first outlet 145. The first outlet 145 of the mixing valve 134 is connected to the inlet 148 of the spout 114. The mixing valve 134 has a second outlet 146 that is connected directly to the intermediate chamber. Thus, regardless of the open or closed state of the flow shutoff valve, the hot and cold water mixture in the intermediate chamber always is able to flow from the second outlet 146. An suitable manual mixing valve is described in U.S. Patent Application Publication No. 2008/0072965, for example, however other types of manual mixing valves can be used.

The second outlet 146 is connected to an electrically operated valve assembly 147 having a single solenoid valve that couples the second outlet to the inlet 148 of the spout 114. Operation of the valve assembly 147 is governed by a controller 150 that includes a control circuit 152 for operating a valve driver 154 connected to the valve assembly 147. The control circuit 152 has an output connected to a light emitter 156 and an input connected to a light sensor 158, wherein the light emitter and the light detector are parts of the proximity detector 130. The controller 150 includes a power supply 159, such as a battery.

The second faucet assembly 110 can be operated automatically in a similar manner as the first faucet assembly 10 by placing a hand or other object in the light beam 132. Such action reflects light back to the sensor within the proximity detector 130. Since light from that light beams only strikes the sensor 158 when an object is present, the control circuit 152 only receives an active signal from the light sensor at that time. At such time, the control circuit responds by sending an output signal to the valve driver 154 that responds by opening the valve assembly 147 to feed the mixture of hot and cold water from the second outlet 146 of the mixing valve 134 to the inlet 148 of the spout 114. The amount that the valve assembly 147 is opened, and thus the flow rate of the water, is preset in the control circuit. Note that the water temperature is determined by the mixing stage of the manual mixing valve 134. Thereafter, the control circuit 152 closes the valve assembly 147 upon either the user again placing a hand or other object in the light beam 132 or after a predefined activation time period has elapsed, whichever occurs first.

The second faucet assembly 110 can be operated manually by the user lifting the lever 144 which opens the flow control valve stage of the mixing valve 134. The amount that the lever is raised determines the degree to which the flow control valve stage opens and thus the flow rate of the water. The flow control valve stage of the mixing valve 134 is connected in parallel with the electrically operated valve assembly 147, thus when either one is open water flows from the intermediate chamber of the mixing valve to the faucet spout 114 and water outlet 122. Regardless of which one of the manual mixing valve 134 or the electrically operated valve assembly 147 is open, rotating the lever 144 of the mixing valve 134 controls the temperature of the water fed to the water outlet 122.

Figure 5:
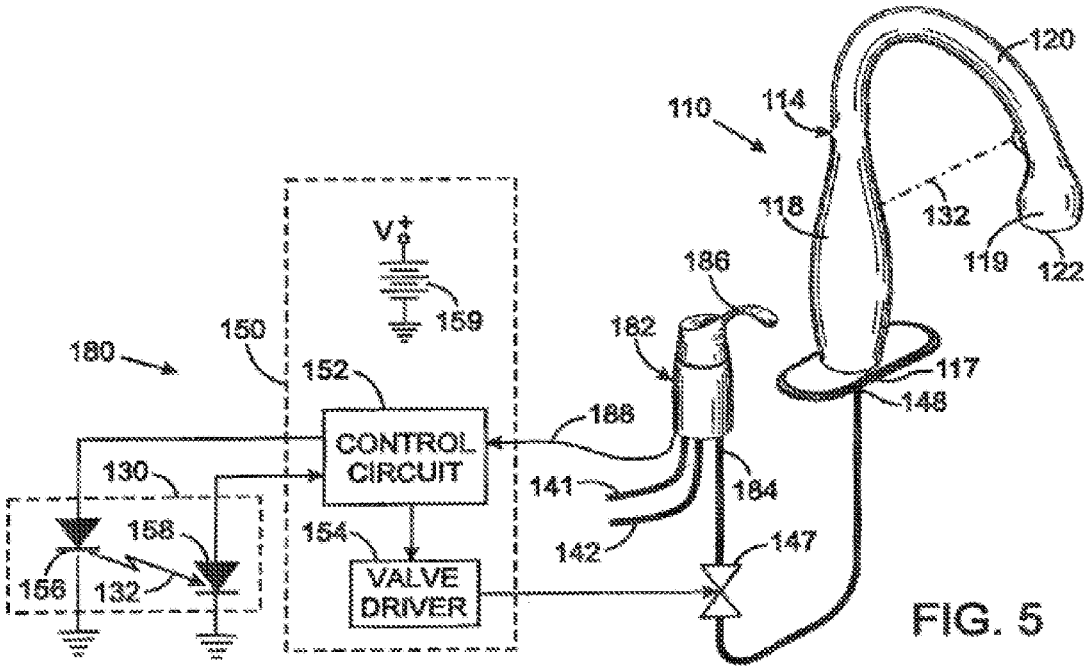
FIG. 5 illustrates the plumbing and controller associated with a third faucet assembly that has a conventional single outlet manual mixing valve.

FIG. 5 illustrates a third faucet assembly 180 that is similar to the second faucet assembly 110, except for using a manually operated mixing valve 182 that has a single outlet 184. Components of the third faucet assembly 180 that are the same as those in the second faucet assembly 110 have been assigned identical reference numerals. Rotation of a lever 186 of the mixing valve 182 varies the proportion of the hot and cold water in the mixture that exits the valve and thus varies the output water temperature. The amount that the lever 186 is tilted controls the flow rate of the water exiting the mixing valve. The mixing valve 182 has an internal electric switch that conducts electric current only when that valve is open thereby providing an valve signal to the control circuit 152 via a cable 188.

The outlet 184 of the mixing valve 182 is connected to the inlet of the electrically operated valve assembly 147, thus those two valves are fluidically connected in series. To turn on the faucet, a user must raise the lever 186 to open the mixing valve 182. This action also closes the internal electric switch of the mixing valve which sends the valve signal to the control circuit 152 indicating that the mixing valve has been opened. The control circuit 152 responds to that valve signal by opening the electrically operated valve assembly 147 to the fully open state. This sends the mixture of water from the mixing valve 182 to the faucet spout 114 and through the water outlet 122. The user does not have to place a hand or other object in the path of the light beam 132 for this water flow to commence.

Now, however, if the user places a hand or other object in the path of the light beam 132, the resultant signal from the light sensor 158 causes the control circuit 152 to close the electrically operated valve assembly 147 and turn off the water flow. If the mixing valve 182 remains open, as indicated to the control circuit 152 by the valve signal on cable 188, removing the hand or other object from the light beam and then reinserting that hand or object into the light beam again causes the control circuit to open the valve assembly 147. Interrupting the light beam repeatedly, toggles the valve assembly 147 between open and closed states as long as the control circuit 152 continues to receive a valve signal indicating that the mixing valve 182 is open.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A faucet, comprising:

a spout;

a light emitter mounted on or in the spout, and configured to emit a beam of light outside of a work region associated with the faucet;

a light sensor mounted on or in the spout proximate the light emitter, the light sensor configured to produce a signal in response to sensing the beam reflected by an object in a zone of detection;

and a control circuit configured to receive the signal and cause a valve of the faucet to control a flow of fluid to the spout.

2. The faucet of claim 1, wherein the spout comprises:

a base configured to be coupled to a mounting surface, and;

an arched portion, wherein the light emitter and the light sensor are mounted on or in the arched portion.

3. The faucet of claim 2, wherein the base extends upwardly from the mounting surface, and wherein the arched portion comprises:

a first portion which curves upward and outward from the base, and;

a second portion, which curves downward and outward from the first portion, wherein the light emitter and the light sensor are mounted on or in the second portion of the arched portion of the faucet.

4. The faucet of claim 1, further comprising a manually operable valve connected in parallel with the valve.

5. The faucet of claim 1, wherein the work region extends down from an outlet end of the arched portion to a boundary defined by an upper periphery of an opening of a basin of a sink with which the faucet is used.

6. The faucet of claim 1, wherein the spout is configured to discharge the flow of fluid within a flow region, and wherein the light emitter and the light sensor are mounted such that the zone of detection does not intersect the flow region.

7. The faucet of claim 1, wherein the light emitter is configured to emit a beam of infrared light.

8. The faucet of claim 1, further comprising:

a hose extending through the spout, fluidly coupled to the valve, and configured to facilitate routing of the flow of fluid through the spout; and a spray head coupled to the hose and selectively coupleable to the spout, the spray head configured to receive the flow of fluid from the hose.

9. The faucet of claim 1, further comprising a mounting plate that is configured to be mounted on at least one of a sink or a counter, wherein the spout comprises a tubular base that is coupled to the mounting plate and extends away from the tubular base.

10. A faucet, comprising:

a spout having a base and an arched portion extending from the base for discharging water;

a proximity detector mounted on or in the arched portion, the proximity detector configured to emit a beam of light outside of a work region associated with the faucet, and further configured to produce a signal in response to sensing the beam reflected by an object placed in a detection zone of the proximity detector; and a control circuit configured to control a flow of water through the faucet based on the signal from the proximity detector.

11. The faucet of claim 10, further comprising a valve, the control circuit operatively coupled to the valve and to the proximity detector, the control circuit configured to receive the signal and cause the valve to control the flow of fluid through the spout after receiving the signal.

12. The faucet of claim 10, wherein the base is configured to be coupled to a mounting surface, the base extending upwardly from the mounting surface, and wherein the arched portion comprises:

a first portion which curves upward and outward from the base, and;

a second portion, which curves downward and outward from the first portion, wherein the proximity detector is mounted on or in the second portion of the arched portion of the faucet.

13. The faucet of claim 11, further comprising a manually operable valve connected in parallel with the valve.

14. The faucet of claim 10, wherein the work region extends down from an outlet end of the arched portion to a boundary defined by an upper periphery of an opening of a basin of a sink with which the faucet is used.

15. The faucet of claim 10, wherein the spout is configured to discharge the flow of water within a flow region, and wherein the proximity detector is mounted such that the zone of detection does not intersect the flow region.

16. The faucet of claim 10, wherein the proximity detector is configured to emit a beam of infrared light.

17. The faucet of claim 11, further comprising:

a hose extending through the spout, fluidly coupled to the valve, and configured to facilitate routing of the flow of fluid through the spout; and a spray head coupled to the hose and selectively coupleable to the spout, the spray head configured to receive the flow of fluid from the hose.

18. The faucet of claim 10, further comprising a mounting plate that is configured to be mounted on at least one of a sink or a counter, wherein the spout comprises a tubular base that is coupled to the mounting plate and extends away from the tubular base.

19. A method of controlling a faucet to discharge a flow of fluid, the faucet including a spout, a light emitter mounted on or in the spout, a light sensor mounted on or in the spout proximate the light emitter, a valve, and a control circuit configured to control the valve to control the flow of fluid, the method comprising:

emitting, by the light emitter, a beam of light outside of a work region associated with the faucet;

sensing, by the light sensor, the beam reflected by an object in a zone of detection and producing a signal in response;

receiving, by the control circuit, the signal from the light sensor; and positioning, by the control circuit, the valve to cause the faucet to discharge the flow of fluid after receiving the signal.

20. The method of claim 19, further comprising:

initiating, by the control circuit, a timer in response to receiving the first signal;

comparing, by the control circuit, the timer to a threshold; and positioning, by the control circuit, the valve to cease causing the faucet to discharge the flow of fluid after determining that the timer exceeds the threshold.

* * * * *